US006532948B2

(12) United States Patent
Grichen

(10) Patent No.: US 6,532,948 B2
(45) Date of Patent: Mar. 18, 2003

(54) TOY ROCKET SET

(76) Inventor: Thomas O. Grichen, 151 Waterwood, Huntsville, TX (US) 77320

( * ) Notice: Subject to any disclaimer, the term of this patent is extended or adjusted under 35 U.S.C. 154(b) by 0 days.

(21) Appl. No.: 09/932,037

(22) Filed: Aug. 17, 2001

(65) Prior Publication Data

US 2002/0020401 A1 Feb. 21, 2002

Related U.S. Application Data

(60) Provisional application No. 60/228,709, filed on Aug. 29, 2000, and provisional application No. 60/225,919, filed on Aug. 18, 2000.

(51) Int. Cl.[7] ..... F41B 11/00; A63H 33/20

(52) U.S. Cl. ..... 124/71; 124/56; 446/52

(58) Field of Search ..... 124/71, 73, 74, 124/56; 446/52, 231, 176, 429, 49, 50, 51; 102/347, 348, 349

(56) References Cited

U.S. PATENT DOCUMENTS

| | | | | | |
|---|---|---|---|---|---|
| 1,079,200 | A | | 11/1913 | Wilde | |
| 1,102,166 | A | | 6/1914 | Quinn | |
| 1,350,103 | A | | 8/1920 | Lehmann | |
| 1,639,602 | A | | 8/1927 | Gay | |
| D135,719 | S | | 5/1943 | Peers | |
| 2,568,475 | A | * | 9/1951 | Vaughan | 446/52 |
| 2,594,627 | A | | 4/1952 | Enidcott | |
| 2,733,699 | A | * | 2/1956 | Krinsky | 124/57 |
| D184,200 | S | | 12/1958 | Swearingen | |
| 3,191,342 | A | * | 6/1965 | Chalmers | 124/16 |
| 3,218,755 | A | * | 11/1965 | Quercetti | 124/17 |
| 3,787,013 | A | * | 1/1974 | McKenzie, Sr. | 102/348 |
| 3,822,502 | A | * | 7/1974 | Belz | 446/52 |
| 4,005,544 | A | | 2/1977 | Donner | |
| 4,038,776 | A | | 8/1977 | Filipeli | |
| 4,223,472 | A | | 9/1980 | Fekete et al. | |
| 4,374,493 | A | * | 2/1983 | Hoffing | 102/348 |
| 4,687,455 | A | * | 8/1987 | Sculatti | 102/348 |
| 5,188,557 | A | | 2/1993 | Brown | |
| 5,381,778 | A | | 1/1995 | D'Andrade et al. | |
| 5,407,375 | A | | 4/1995 | Johnson | |
| 5,415,153 | A | * | 5/1995 | Johnson et al. | 124/57 |
| 5,538,453 | A | | 7/1996 | Johnson | |
| 5,549,497 | A | | 8/1996 | Johnson et al. | |
| 5,653,216 | A | * | 8/1997 | Johnson | 124/69 |
| 5,951,354 | A | * | 9/1999 | Johnson | 446/429 |
| 6,321,737 | B1 | * | 11/2001 | Johnson et al. | 124/56 |

* cited by examiner

*Primary Examiner*—Michael J. Carone
*Assistant Examiner*—John W. Zerr
(74) *Attorney, Agent, or Firm*—Bracewell & Patterson, L.L.P.

(57) ABSTRACT

A toy rocket set that includes a rocket and a launcher for the rocket that utilizes compressed air to launch the rocket. The upper end of the launch tube has an end cap secured thereupon by a threaded connection. An annular elastomeric element is retained between the end cap and the launch tube body. As the end cap is tightened onto the launch tube body, the elastomeric element is compressed resulting in an adjustable frictional engagement with a radially enlarged nose cone on the rocket. The centerpoint of the parachute is secured by a tether to a removable link in the rocket body. The removable link is retained within the rocket body by a slidable rod. During flight, when the rocket inverts, the rod slides within the rocket body to release the link and permit the parachute to deploy to an open position.

12 Claims, 3 Drawing Sheets

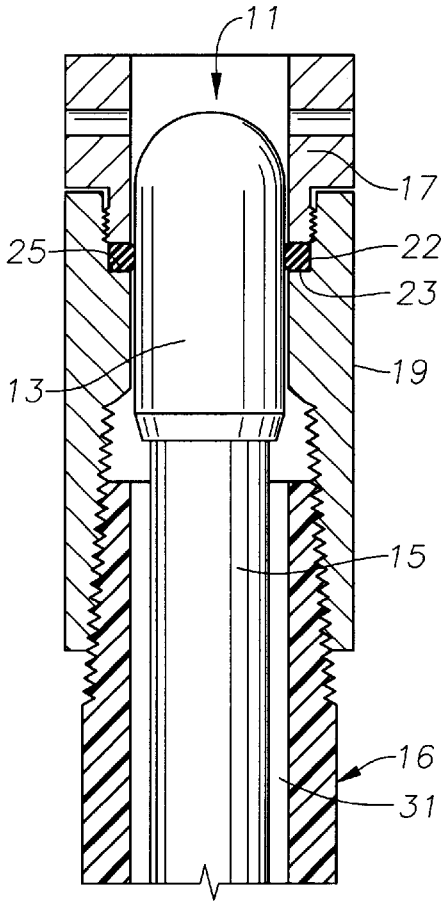
Fig. 1
Fig. 2
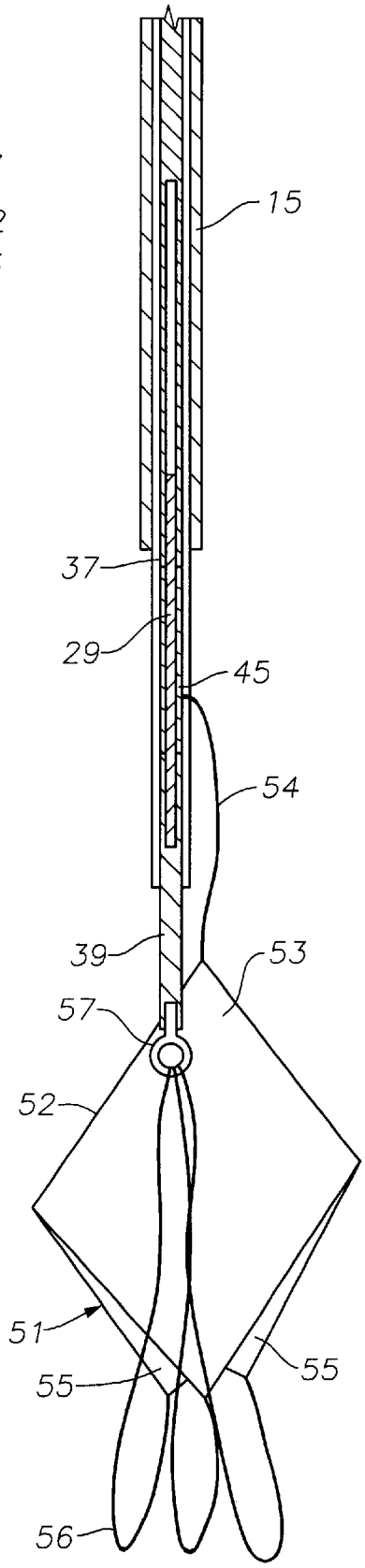
Fig. 4
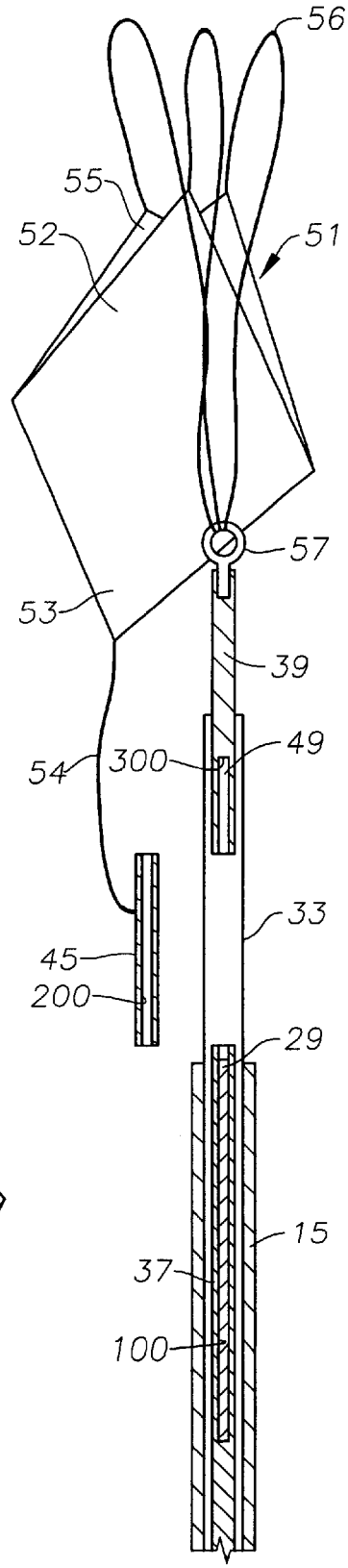

TOY ROCKET SET

CROSS-REFERENCED TO RELATED APPLICATIONS

This application claims the priority of U.S. Provisional Patent Application No. 60/228,709 filed Aug. 29, 2000, and U.S. Provisional Patent Application 60/225,919 filed Aug. 18, 2000.

BACKGROUND OF THE INVENTION

1. Field of the Invention

The present invention relates to toy rocket launcher sets having a toy rocket and rocket launching device. In particular aspects, the invention relates to such rocket launcher sets wherein a compressed fluid, such as air, is used to propel the rocket.

2. Description of the Related Art

Toy rocket sets have been used and enjoyed by children for a long time. A number of rocket launcher sets are known that utilize compressed fluid, usually air, to propel the toy rocket skyward. Typical problem areas for these rocket launcher sets include the launching mechanism and the means by which a parachute for the rocket is deployed.

Many conventional compressed fluid rocket launcher sets are unable to launch a rocket to a very high altitude because of inherent limitations in the launching mechanism. Some compressed fluid launchers rely upon an interference fit-type seal that is formed between the rear opening of the rocket and the mouth of the fluid supply. Fluid pressure is built up within the body of the rocket until the grip provided by the interference seal is overcome. One such system is described in U.S. Pat. No. 5 ,188,557 issued to Brown. With these systems, the amount of fluid pressure that can be built up is limited by the grip of the interference seal. Further, as the rocket set ages, the interference seal typically degrades due to wear and tear and may not easily be replaceable. Degradation of the seal causes loss of performance for the rocket.

U.S. Pat. No. 2,733,699 issued to Krinsky describes a compressed air launching mechanism wherein a knob is depressed to cause previously pressurized air to enter the launching chamber of the launcher and, thus, launch the rocket. While such a system is effective in permitting sufficient air pressure to be built up for a successful launch, it adds a level of complexity to the toy that is undesirable.

It is a preferred feature for a toy rocket set to have a parachute that deploys from the rocket during its flight to slow the decent of the rocket toward the earth. The parachute is both a visual treat and, as a practical matter, helps prevent structural damage to the rocket from a hard landing. Additionally, a deployed parachute is a valuable aid in locating the landed rocket. However, the process of successfully deploying a parachute is problematic. It is desirable to have the chute deploy at about the time the rocket has stopped rising and begins its decent. An earlier-deploying chute will slow the rocket's ascent, while a later-deploying chute may not sufficiently slow the rocket's fall, thereby allowing damage to occur.

Some systems are known that have attempted to address the problem of deploying the chute in flight. U.S. Pat. No. 5,407,375, issued to Johnson, describes a velocity dependent chute release in which the parachute is initially stored within compartment in the rocket. When the rocket is launched and reaches its apogee, a velocity dependent chute release mechanism causes a hatch on the nose of the rocket to open. With the hatch opened, the parachute within may deploy and open. In practice, however, the release mechanism may not be effective to cause opening at the desired time. In addition, the release mechanism is relatively complex being made up of numerous small parts.

U.S. Pat. No. 1,079,200, issued to Wilde, describes an elongated, tubular toy rocket having a parachute affixed to a first weight retained within a rear portion of the rocket body. The weight is initially secured against axial movement within the rocket body by a rod. After the rocket is launched, reaches its apogee and noses over to descend, a second weight slides forward inside of the rocket and triggers a latch. Triggering of the latch allows the rod and first weight to move rearwardly inside the body of the rocket and, thereby, permitting the parachute to fully deploy and open. Wilde's arrangement is prone to failure when actually used. The latch does not always release the rod, as intended.

An improved rocket launcher set, which addresses the problems of the prior art, would be desirable.

SUMMARY OF THE INVENTION

The present invention features a toy rocket set that includes a rocket and a launcher for the rocket that utilizes compressed air to launch the rocket. The launching mechanism for the rocket set features a launching tube into which the rocket is inserted. The upper end of the launch tube has an end cap secured thereupon by a threaded connection. An annular elastomeric element, i.e., a common O-ring, is retained between the end cap and the launch tube body. As the end cap is tightened onto the launch tube body, the elastomeric element is compressed resulting in a frictional engagement with a radially enlarged nose cone on the rocket. Fluid pressure is then increased within a chamber within the launch tube tending to force the rocket upwardly out of the upper end of the launch tube. Once the fluid pressure increases to the point where the upward force upon the rocket overcomes the frictional forces between the elastomeric element and the nose cone, the rocket is launched from the launch tube. It is possible to adjust the tightness of the end cap, thereby increasing the frictional forces retaining the rocket within the launch tube and requiring a greater fluid pressure build up in order to launch the rocket. Thus, by selectively tightening the end cap, a greater maximum height for the rocket can be achieved.

The toy rocket has a novel and advantageous parachute deployment mechanism. The edges of a parachute are secured to the rear end of the rocket body by several links. The centerpoint of the parachute is secured by a tether to a removable link in the rocket body. The removable link is retained within the rocket body by a slidable rod. The nose cone of the rocket is weighted so that, when the rocket begins its descent, it will invert to a nose down position. During flight, when the rocket inverts, the rod slides within the rocket body to release the link and permit the parachute to deploy to an open position. In practice, this deployment mechanism has proven effective and reliable.

BRIEF DESCRIPTION OF THE DRAWINGS

A detailed description of the invention will be made with reference to the accompanying drawings wherein like numerals designate corresponding parts in the several figures.

FIG. 1 is a longitudinal-section view of an upper section of a launch tube and rocket constructed in accordance with this invention and shows a rocket installed within the launch tube;

FIG. 2 is a longitudinal-section view of a lower section of a rocket and parachute release system constructed in accordance with the invention and shows the system in the launch and ascent configuration;

FIG. 4 is a longitudinal-section view of a lower section of a rocket and parachute release system constructed in accordance with the invention and shows the system in the descent configuration;

DETAILED DESCRIPTION OF THE PREFERRED EMBODIMENTS

Figure 3:
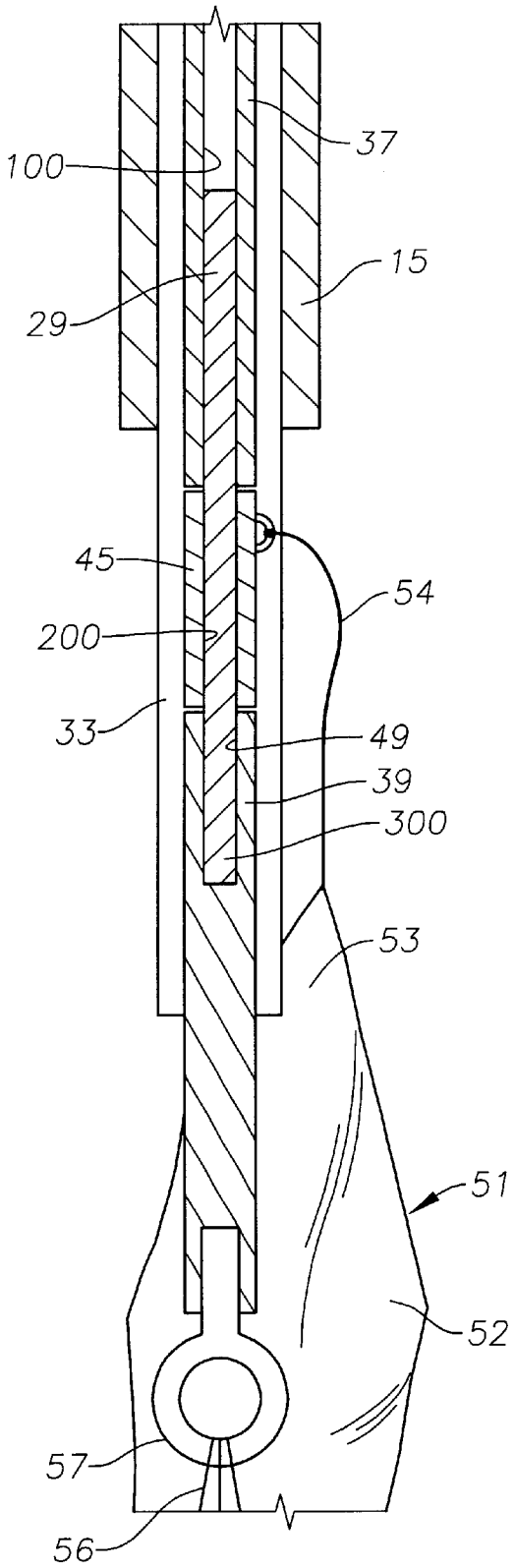
FIG. 3 is an enlarged longitudinal-section view of a parachute release system constructed in accordance with the invention and shows the system in the launch and ascent configuration.

Referring to FIG. 1, a toy rocket launcher set is shown wherein a toy rocket 11 is installed within a launch tube 16. The rocket 11 has a body 15 that is a tubular structure having a nose cone 13 on the upper end. It is noted that the nose cone 13 has a larger diameter than the rocket body 15. It is also pointed out that the nose cone 13 is weighted. The launch tube 16 is tubular with its inside diameter being larger than that of the body 15 of the rocket 11. The lower end of a seal holder 19 is attached by threads to the upper end of the main tube body 16 and has an inner shoulder 23 for supporting an elastomeric sealing element, i.e., a common, easily replaceable O-ring seal 25. An end cap 17 is attached to the upper end of the seal holder 19 with threads. The end cap 17 has an inner shoulder 22 for retaining and compressing the seal 25 between the shoulder 22 of the end cap and the shoulder 23 of the seal holder 19. The nose cone 13 engages the seal 25 when a rocket 11 is in the launch tube 16 and presents a rounded forward profile for reduced aerodynamic drag on the rocket 11. The seal 25 retains pneumatic pressure within a chamber 31 for launching the rocket 11. The rocket 11 remains in the launch tube 16 until the upward force on the rocket 11 caused by the pneumatic pressure within the chamber 31 exceeds the force of the friction between the seal 25 and the nose cone 13. Once the frictional force is exceeded, the rocket 11 is then propelled out of the launch tube 16 by the pressurized air in the chamber 31.

The friction between the seal 25 and the nose cone 13 is adjustable by moving the end cap 17 axially relative to the seal holder 19. Turning the end cap 17 in a direction that causes the end cap and seal holder 19 to move closer compresses the seal 25 between the shoulders 22, 23. This causes the seal 25 to expand radially inward and causes greater static friction between the seal 25 and the nose cone 13. This requires more pneumatic pressure in the chamber 31 to overcome the friction, resulting in a higher launch velocity and a greater maximum altitude in flight. Turning the end cap 17 in a direction causing less compressive force on the seal 25 reduces the friction between the seal 25 and the nose cone 13 and reduces the pressure necessary to launch the rocket 11. The reduced pneumatic pressure results in a lower maximum altitude during flight.

The positions of the components of a parachute release system during launch and the ascent portion of the flight path are illustrated in FIGS. 2 and 3. The lower end of the body 15 of the rocket 11 is open. A receiver support 33 is attached within the body 15 and extends beyond the lower end of the body 15. A guide tube 37 having a bore 100 is attached within the body 15 and to the receiver support 33 such that only a small lower portion extends out of the lower end of the body 15. A receiver 39 is attached to the lower end of the receiver support 33 and has a bore 49 for receiving a rod 29. Receiver 39 and guide tube 37 have coaxial bores and opposing ends spaced apart from each other. A release link 45 is releasably inserted in the space between the ends of the guide tube 37 and the receiver 39. Link 45 is also supported by the receiver support 33, but is not rigidly attached to it. The release link 45 has a bore 200 that is coaxial with the bores 49, 100 of the receiver 39 and guide tube 37, respectively, while inserted between them. Release link 45 is retained in position by an elongated, weighted rod 29 that is slidably disposed within the bores of the guide tube 37, link 45 and receiver 39. The lower end of the rod 29 is retained by closed end 300 in the bore of receiver 39. The rod 29 has sufficient length to ensure that an upper portion of the rod 29 remains in the guide tube 37 when the release system is in the launch position.

A parachute assembly 51 is affixed to the rocket body 15 for deployment during flight. The parachute assembly 51 has a canopy 52 with a central portion 53 that is attached to the release link 45 by a tether 54. Edge portions 55 of the canopy 52 are attached to the rocket 11 by flexible leads 56 that are tied off to a lead attachment ring 57 that is incorporated into the lower end of the receiver 39. It is noted that the connection of the central portion 53 of the canopy 52 with the body 15 of the rocket 11 maintains the parachute assembly 51 in an undeployed position during initial skyward flight. In this position, the top of the canopy 52 faces forward and the parachute assembly 51 is prevented from expanding in the impinging air.

Figure 5:
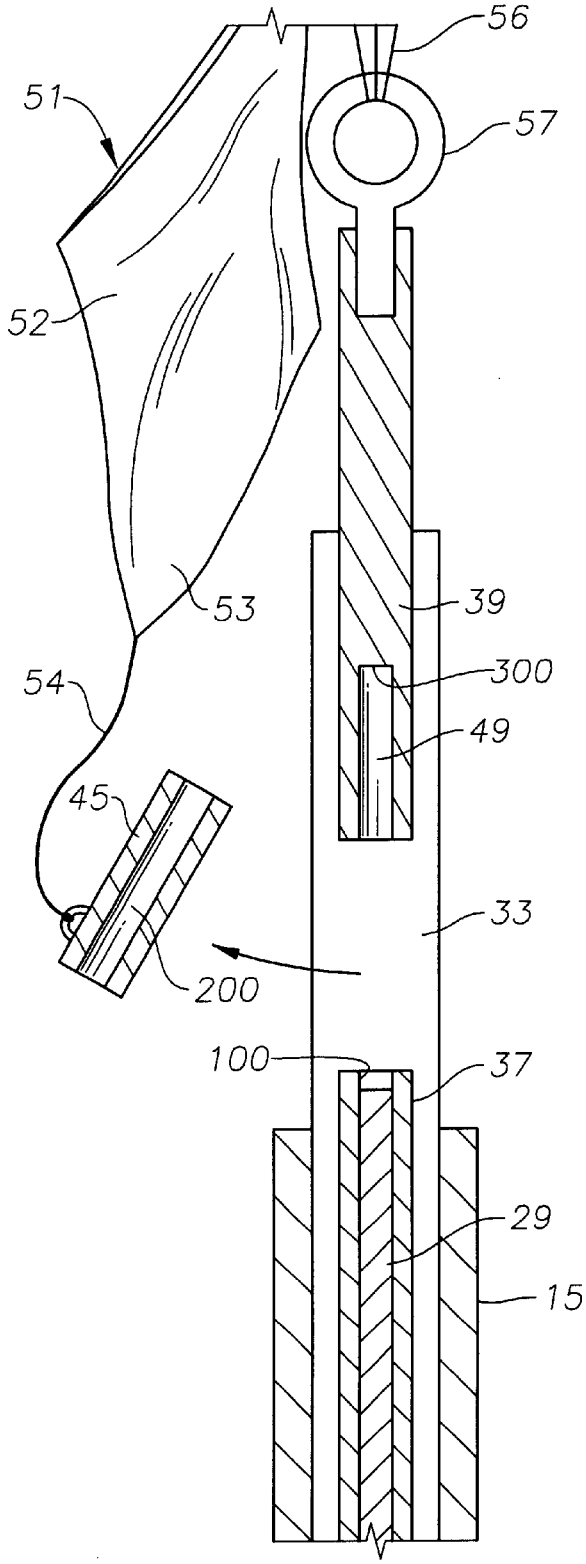
FIG. 5 is an enlarged longitudinal-section view of a parachute release system constructed in accordance with the invention and shows the system in the descent configuration.

FIGS. 4 and 5 show the positions of the components of the release system after the rocket 11 has rotated into a nose-down attitude and begun its descent. As the nose cone 13 begins to point downward, gravity causes the lower end of the rod 29 to slide out of the receiver bore 49 and bore 200 of release link 45 and fully into the guide tube 37. Rod 29 is preferably metal so as to have sufficient weight to slide downward, overcoming the friction between rod 29 and bores 100, 200, 49. Once the rod 29 is out of engagement with release link 45, the link 45 is free to move away from receiver 39. As shown in FIG. 5, this allows the parachute assembly 51 to pull the release link 45 from its position between the guide tube 37 and receiver 39. Aerodynamic drag causes the parachute assembly 51 to trail behind the rocket I 1 and exposes the underside of the parachute assembly 51 to the impinging air. The parachute assembly 51 expands, and the resultant drag slows the descent of the rocket 11.

To prepare the rocket 11 for launch, the rocket body 15 is rotated into a nose-down attitude. With the parachute assembly tether 54 attached, the release link 45 is placed between the lower end of the guide tube 37 and the upper end of the receiver 39. The rocket 11 is then rotated into a nose-up attitude which allows gravity to pull the lower end of the rod 29 out of the guide tube 37, through the release link 45 and into the receiver bore 49. With the nose pointed upward, the rocket 11 is inserted into the launch tube 16 until the diametrically enlarged nose cone 13 firmly engages the seal 25. End cap 17 is loosened to reduce friction between seal 25 and rocket 11 during insertion and then tightened before launch.

Figure 6:
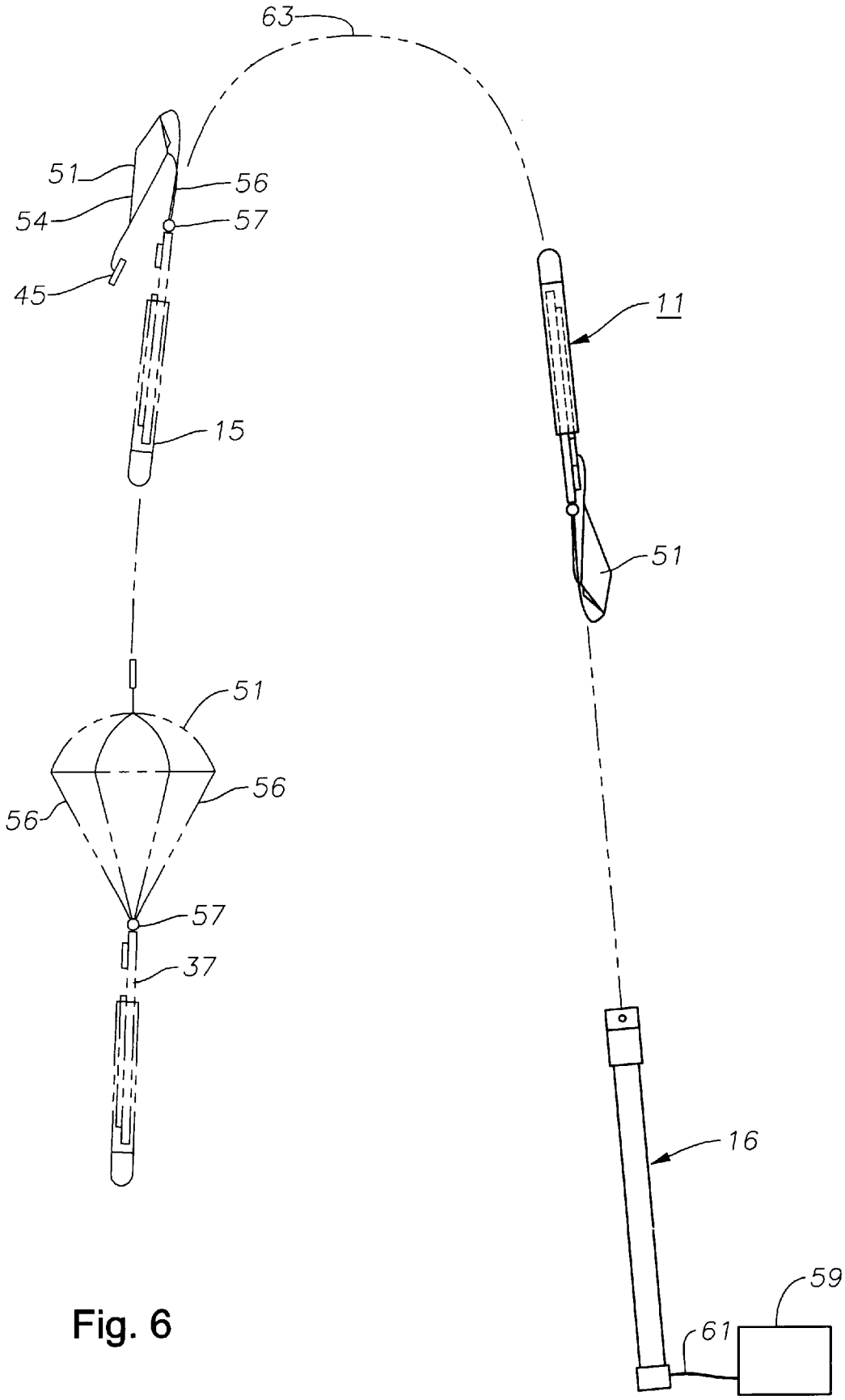
FIG. 6 is a profile view of the flight path of a rocket constructed in accordance with the invention and shows the various stages during the flight of the rocket.

Referring to FIG. 6, a pressurized air source 59 is connected to the launch tube 16 with a hose 61 and is in communication with the chamber 31 of the launch tube 16. The chamber 31 is pressurized until the upward force on the rocket 11 exceeds the static frictional force between the seal 25 and nose cone 13. The pressure causes the rocket 11 to accelerate out of the launch tube 16 and begin a parabolic flight path. Near the apogee 63 of the flight path, the rocket 11 begins to rotate into a nose-down attitude due to the weighted nose cone 13. This allows gravity to pull the rod 29 toward the nose cone 13 until the rod 29 is entirely within the guide tube 37. The drag on the parachute assembly 51 causes a lateral force in the receiver support 33 that pulls the release link 45 away from its position between the guide tube 37 and the receiver 39, as shown in FIG. 5. The parachute assembly 51 rotates to trail behind the rocket 11 and the canopy 52 expands due to the impinging air. The drag force is transmitted to the rocket 11 through the leads 56 and slows the rocket 11. Factors affecting when the parachute assembly 51 deploys include the size of the canopy 52, the weight of the rod 29, and the weight of the nose cone 13.

While the invention has been shown and described in only one of its forms, it is not thus limited but is susceptible to various changes and modifications without departing from the spirit and scope of the invention.

What is claimed is:

1. A toy rocket launcher set comprising:

a) a rocket having an elongated, tubular rocket body having a first diameter and a nose cone having a second diameter that is greater than the first diameter; and b) a compressed fluid rocket launcher for launching the rocket, the launcher comprising:

a launch tube defining a passage for retaining the rocket therein prior to launching;

a pressurized fluid source operably interconnected with the launch tube;

an annular elastomeric seal member within the passage of the launch tube for engaging the nose cone of the rocket in a frictional engagement; and wherein the launch tube further comprises:

a launch tube body having an upper end opening; and an end cap that is threadedly engaged with the upper end opening.

2. The toy rocket launcher set of claim 1 wherein the seal member is retained within the passage between the end cap and the launch tube body so that the amount of frictional engagement of the seal member with the nose cone can be adjusted by adjustment of the threaded engagement of the end cap.

3. The toy rocket launcher set of claim 1 further comprising a parachute assembly affixed to the rocket body.

4. The toy rocket launcher set of claim 3 wherein the parachute assembly comprises:

a canopy having a central portion and edge portion;

a plurality of leads affixing the edge portion of the canopy to the rocket body; and a tether releasably securing the central portion of the canopy to the rocket body.

5. The toy rocket launcher set of claim 4 further comprising a release assembly for the tether, the release assembly comprising a link member releasably retained within the rocket body.

6. The toy rocket launcher set of claim 5 wherein the release assembly further comprises a weighted rod member slidably disposed within the rocket body between a first position wherein the rod member engages the link member to secure the link member within the rocket body and a second position wherein rod member disengages the link member to release the link member from the rocket body.

7. The toy rocket launcher set of claim 6 wherein the rod member is moved to the second position when the rocket body is in an inverted position.

8. A toy rocket launcher set comprising:

a) a rocket comprising:

an elongated, tubular rocket body having a first diameter;

a nose cone having a second diameter that is greater than the first diameter;

a parachute assembly affixed to the rocket body for slowing descent of the rocket;

b) a compressed fluid rocket launcher for launching the rocket, the launcher comprising:

a launch tube defining a passage for retaining the rocket therein prior to launching;

a pressurized fluid source operably interconnected with the launch tube;

an annular elastomeric seal member within the passage of the launch tube for engaging the nose cone of the rocket in a frictional engagement; and wherein the launch tube comprises:

a launch tube body;

an end cap that is threadedly engaged with the launch tube body; and the elastomeric seal member is selectively axially compressible by adjustment of a threaded connection to adjust the amount of frictional engagement between the elastomeric element and the nose cone.

9. The toy rocket launcher set of claim 8 wherein the parachute assembly comprises:

a canopy having a central portion and edge portion;

a plurality of leads affixing the edge portion of the canopy to the rocket body; and a tether releasably securing the central portion of the canopy to the rocket body.

10. The toy rocket launcher set of claim 9 further comprising a release assembly for the tether, the release assembly comprising a link member releasably retained within the rocket body.

11. The toy rocket launcher set of claim 10 wherein the release assembly further comprises a weighted rod member slidably disposed within the rocket body between a first position wherein the rod member engages the link member to secure the link member within the rocket body and a second position wherein rod member disengages the link member to release the link member from the rocket body.

12. The toy rocket launcher set of claim 11 wherein a central bore is defined within the link member and the rod member engages the link member by being slidably disposed within the central bore.

* * * * *